US005330116A

United States Patent [19]

Meyer

[11] Patent Number: 5,330,116

[45] Date of Patent: Jul. 19, 1994

[54] METHOD OF AND APPARATUS FOR ROLLING UP PLASTIC FOIL

[75] Inventor: Helmut Meyer, Troisdorf, Fed. Rep. of Germany

[73] Assignee: Reifenhauser GmbH & Co. Maschininfabrik, Troisdorf, Fed. Rep. of Germany

[21] Appl. No.: 822,462

[22] Filed: Jan. 17, 1992

[30] Foreign Application Priority Data

Feb. 22, 1991 [DE] Fed. Rep. of Germany ..... 4105597

[51] Int. Cl.[5] ..... B65H 19/00

[52] U.S. Cl. ..... 242/533.2

[58] Field of Search ..... 242/56 A, 65

[56] References Cited

U.S. PATENT DOCUMENTS

| | | | |
|---|---|---|---|
| 3,071,333 | 1/1963 | Looser | 242/58.2 |
| 3,472,462 | 10/1969 | Young | 242/56 A |
| 3,684,202 | 8/1972 | Otani | 242/56 A |
| 3,831,876 | 8/1974 | Phelps | 242/56 A |
| 4,171,780 | 10/1979 | Bugnone | 242/56 A |
| 4,964,585 | 10/1990 | Negrussi | 242/56 A |
| 4,967,974 | 11/1990 | Kawamura | 242/58.1 X |
| 5,046,224 | 9/1991 | Bogucki-Land | 242/56 A |

FOREIGN PATENT DOCUMENTS

| | | |
|---|---|---|
| 1892475 | 3/1964 | Fed. Rep. of Germany . |
| 3041030 | 3/1964 | Fed. Rep. of Germany . |
| 1499028 | 8/1965 | Fed. Rep. of Germany . |
| 1091856 | 4/1970 | Fed. Rep. of Germany . |
| 2016588 | 4/1970 | Fed. Rep. of Germany . |
| 2317325 | 11/1974 | Fed. Rep. of Germany . |
| 3216399 | 11/1983 | Fed. Rep. of Germany . |

*Primary Examiner*—Daniel P. Stodola
*Assistant Examiner*—Eileen A. Dunn
*Attorney, Agent, or Firm*—Herbert Dubno; Andrew Wilford

[57] ABSTRACT

A winding machine for plastic foil webs has two pairs of arms which can be swung about a common axis and which all have the same length so that the pairs of arms rotate like the hands of a clock. As one pair of arms has a roll wound on a winding sleeve therebetween, the other pair of arms holds its winding sleeve in readiness at a rest position. When the finished roll is swung away from the winding position and is severed from the oncoming web, the winding tube between the second arms is brought into the winding position.

1 Claim, 3 Drawing Sheets

METHOD OF AND APPARATUS FOR ROLLING UP PLASTIC FOIL

FIELD OF THE INVENTION

My present invention relates to a method of and to an apparatus for the rolling up of synthetic resin (plastic) foil webs on winding tubes. More particularly, the invention relates to the winding up of such webs upon a succession of winding tubes. It should be understood that, in such a process, the foil is generally supplied in a continuous manner and each roll, after it has been fully wound, is separated from the common foil web which is applied to the next winding tube of the succession and as the roll is completed thereon, the process is repeated until all of the winding tubes have had rolls wound thereon.

BACKGROUND OF THE INVENTION

The winding of synthetic resin or plastic foil webs onto a succession of winding tubes had, in the past, made use of a turret arrangement (German patent document 23 17 325) or an endless conveyor system (German patent document 32 16 399).

In the first of these systems, the turntable, turret or winding tube carrier has two pairs of oppositely disposed arms on the turret between which winding tubes can be received and in fixed angular relationship about the axis of rotation of the turret.

When one winding tube is in the winding position to receive the web and form a roll, a completed roll on the other pair of arms can be removed and a new winding tube inserted so that, upon rotation of the turret through 180°, a completed roll is moved out of the winding position and a fresh winding tube is positioned at the winding position.

In the endless chain system, winding tubes are entrained in succession of the winding position between pairs of endless chains which carry away the completed rolls. Both systems are expensive, occupy considerable space and require complex kinematics and auxiliary elements to effect roll transfer, winding tube insertion and the like.

In practice it is found that they cannot be used effectively when the foil is fed at high speed and high-speed change at the winding position of a completed roll if a new winding tube is required.

OBJECTS OF THE INVENTION

It is, therefore, the principal object of the present invention to provide an improved method of operating a winding machine whereby the aforementioned drawbacks are avoided.

It is also an important object of this invention to provide an improved winding machine which eliminates the complex kinematics of earlier systems and is simple to construct and operate.

Still another object of the invention is to provide an improved operation of a winding machine for winding up plastic foil webs onto a plurality of winding tubes or winding sleeves in succession which has simpler kinematics than earlier machines, greater functional reliability and higher speeds of operation in terms of the speeds with which the web is fed to the winding station.

SUMMARY OF THE INVENTION

These objects are attained, in accordance with the invention, by an operation in which the plastic foil web is wound on a winding tube or sleeve and wherein a first pair of arms spaced apart by the length of a sleeve accommodate a winding sleeve while a second pair of arms, also spaced at least by the length of a sleeve, can receive another winding tube or sleeve, all of these arms being of the same length and rotatable about the same geometric axis.

The pair of first arms receives the respective winding sleeve and displaces it into winding position in which the web is wound to a roll thereon while the second pair of arms holds its sleeve in a rest position.

When the roll is completed, the first pair of arms swings the finished roll into at least one waiting position while the second pair of arms swings the other winding sleeve into the winding position, winding is commenced on the new sleeve or winding tube and a transverse separation of the foil web is effected. The first pair of arms then brings the completed roll into a roll-removal position as the new roll is being wound up on the sleeve between the second pair of arms and then the first pair of arms with a new sleeve thereon is swung into the waiting position so that the process can be repeated.

In method terms, therefore, the invention comprises the steps of:

(a) feeding a plastic foil web to a winding position;

(b) engaging a winding tube between a pair of first arms and rotating the pair of first arms about an axis to dispose the winding tube at the winding position, and winding the plastic foil web fed to the winding position on the winding tube while rotating same;

(c) engaging another winding tube between a pair of second arms of the same lengths as the first arms and rotatable about the axis independently of the first arms;

(d) during step (b), rotating the pair of second arms about the axis to position the other winding tube at a waiting position angularly spaced about the axis from the winding position;

(e) upon completion of winding of a roll of the plastic foil web on the winding tube engaged by the pair of first arms, successively rotating the pair of first arms out of the winding position to position the roll in another position angularly spaced from the winding position about the axis, rotating the second pair of arms about the axis to displace the other winding tube from the waiting position into the winding position, and transversely severing the web to separate the roll from web applied to the other winding tube;

(f) angularly displacing the pair of first arms about the axis into a removal position at which the roll is removed;

(g) winding the plastic foil web fed to the winding station onto the winding tube between the pair of second arms; and (h) introducing a winding tube between the pair of first arms from which a roll has been removed, and repeating steps (b) through (h) until rolls of the web have been wound on all of the winding tubes.

The apparatus for winding up the web into rolls on successive sleeves or winding tubes can comprise:

means for feeding a plastic foil web to a winding position;

a pair of first arms engaging a winding tube between them;

means for mounting the first arms defining an axis of rotation for the pair of first arms;

means for rotating the pair of first arms about the axis to dispose the winding tube at the winding position;

means for winding the plastic foil web fed to the winding position on the winding tube while rotating same;

a pair of second arms of the same lengths as the first arms and rotatable about the axis independently of the first arms, the second arms engaging another winding tube between them, one of the pairs of arms being disposed inwardly of the other pair of arms; and control means for, in sequence:

during winding of a roll of the web onto the winding tube between the first arms at the winding station, rotating the pair of second arms about the axis to position the other winding tube at a waiting position angularly spaced about the axis from the winding position, upon completion of winding of a roll of the plastic foil web on the winding tube engaged by the pair of first arms, successively rotating the pair of first arms out of the winding position to position the roll in another position angularly spaced from the winding position about the axis, rotating the second pair of arms about the axis to displace the other winding tube from the waiting position into the winding position, and transversely severing the web to separate the roll from web applied to the other winding tube, angularly displacing the pair of first arms about the axis into a removal position at which the roll is removed, winding the plastic foil web fed to the winding station onto the winding tube between the pair of second arms, and displacing a further winding tube positioned between the first arms from which a roll has been removed for repeating the sequence.

The arms of the present invention thus operate by rotation in a single sense, either clockwise or counterclockwise, but function substantially like the hands of a clock, the arms of one pair lying within the arms of the other. Unlike a turret arrangement with a fixed angle between the pairs of arms, the angle between the pairs of arms of the present apparatus can and do vary during the process. This results in a very simple kinematic relationship and permits a highly compact construction of the winding machine.

It will be understood that the system of the invention can make use of conventional auxiliary devices, for example, guide and feed rolls for supplying the web, contact or pressing rolls for holding the web against the roll as it is wound, and transverse severing tubes of any conventional type. Conventional systems for feeding the winding tubes to the arms, removing the completed rolls and monitoring the operation of the system can also be used. For example, the winding tubes can be extracted from a magazine or store of such tubes in conventional manner and can be placed between the arms also in a conventional way. The arms can be provided with winding cones engageable in the ends of the winding tubes, etc.

The drive systems can be conventional as well. Utilizing modern drive and control technology, for example, the pairs of arms can be driven by independent motors controlled by a computer, although it is also possible to couple the arms for synchronous movement by a crank-type drive or the like.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
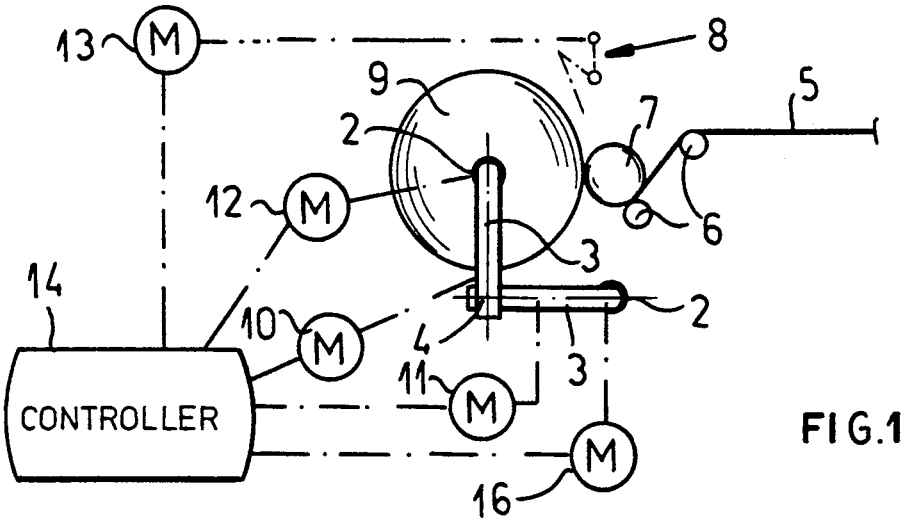
FIGS. 1–8 are diagrammatic end views illustrating successive steps in the process of the invention.
Figure 2:
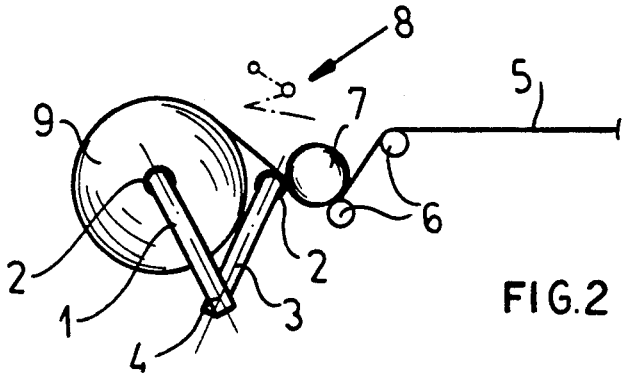
Figure 3:
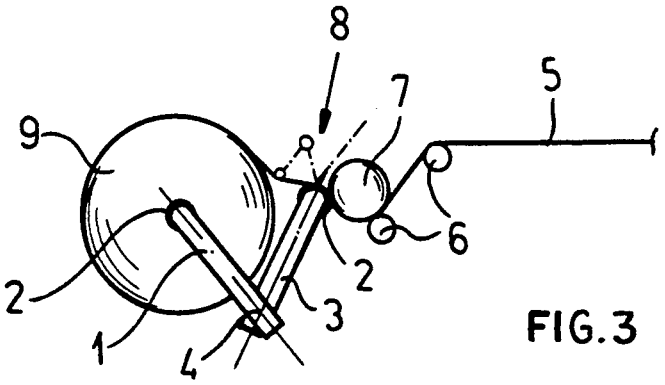

FIGS. 1–8 show the steps in the process of the invention. The roll-winding apparatus has a first pair of arms i spaced apart by at least the length of a roll to be wound and provided with cones 20 which can be axially advanced to engage a winding sleeve or tube 2 between them (see FIG. 9). A second pair of arms 3 also have tube-engaging cones 21 which can engage in the ends of a winding tube 2.

All of the arms 1 and 3 are of equal length and are swingably mounted on the same axis 4 in pairs which are independently swingable.

Figure 9:
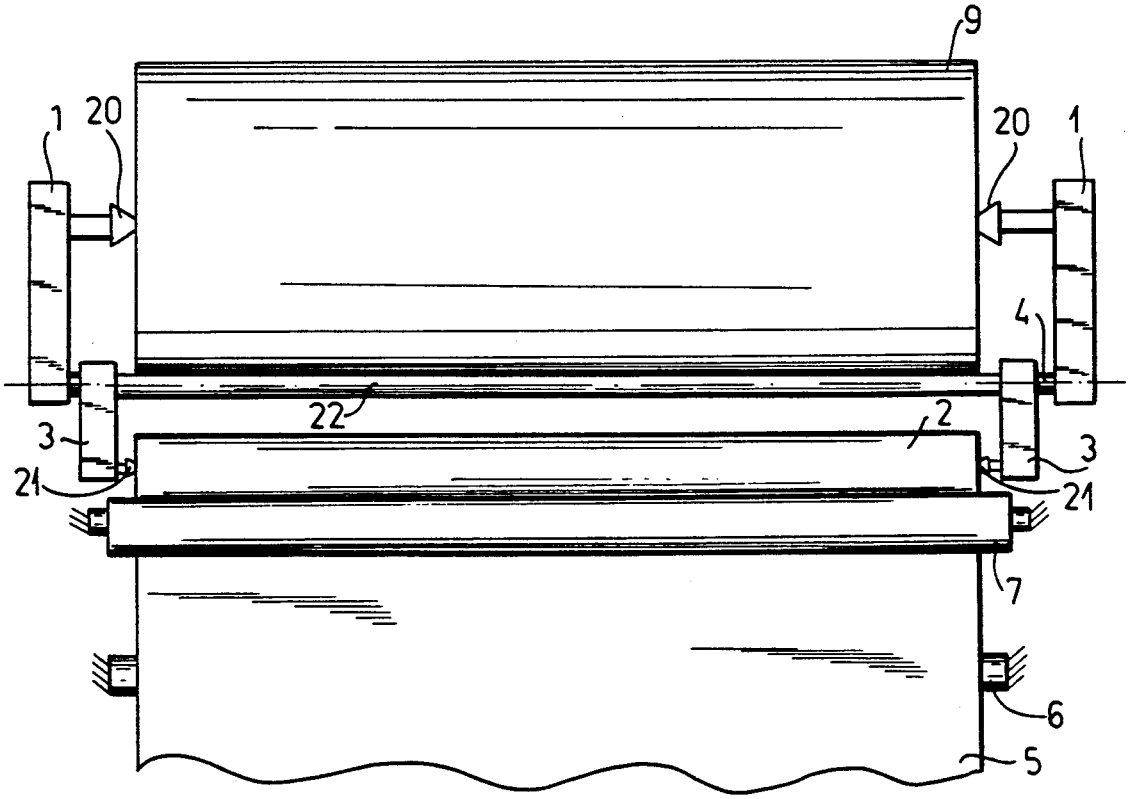
FIG. 9 is a plan view showing the pairs of arms in greater detail and as viewed in the positions of the parts of FIG. 4.

While the pairs of arms are apparent from FIG. 9, in FIGS. 1–8, only one arm of each pair can be seen.

From FIG. 1 it will be apparent that initially the first pair of arms 1, in which a winding tube 2 is received, has had a roll 9 substantially completely wound thereon. In the winding station adjacent a contact roller 7 about which the web 5 is guided and which applies that web to the roll 9, the second pair of arms 3 is in a waiting or rest position angularly spaced from the arms 1. A second winding tube 2 is shown to be already mounted between the arms 3 although it can be introduced just before these arms are swung in the counterclockwise sense into the winding position.

The apparatus also includes guide rollers 6 for the plastic foil web 5 to be wound up and a transverse severing device 8 shown only in highly diagrammatic form, which can be actuated to cut the web across its width and separate a finished roll from the oncoming web.

When the winding is complete (FIG. 2), the first pair of arms 1 swing the roll 9 into at least one waiting position while the second pair of arms 3 present the new winding tube 2 at the winding position against the roller 7. The severing device 8 is actuated (FIG. 3) to cut the foil away from the completed roll.

Figure 4:
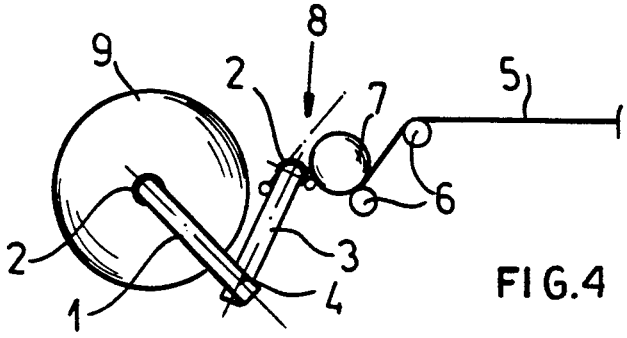
Figure 5:
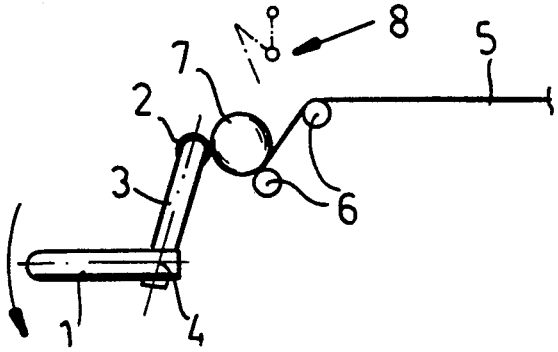

As can be seen from FIG. 4, while the first pair of arms 1 swing the finished roll into a position at which the roll can be removed (compare FIG. 5), the severing device 8 applies the leading end of the web to the new winding sleeve 2 and winding of a new roll commences thereon.

Figure 6:
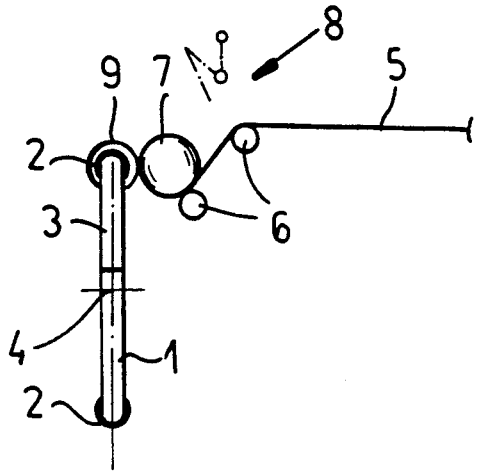
Figure 7:
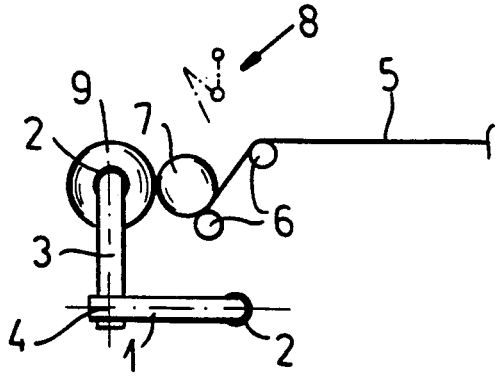
Figure 8:
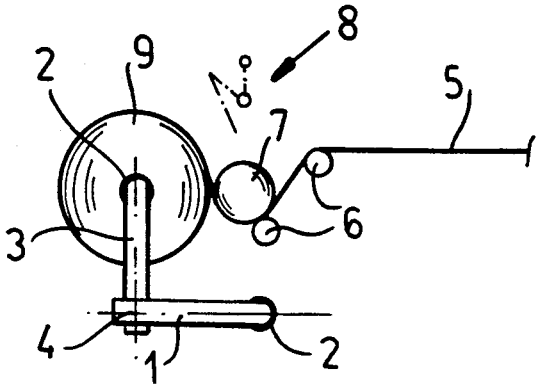

The arms from which the roll has been removed (FIG. 5) can continue to swing in the counterclockwise sense until it is in the position spaced angularly from the winding position by 98 and shown in FIG. 6 at which a new winding tube 2 is inserted between them.

With the new winding tube 2 in place, the first pair of arms is swung in the counterclockwise sense (FIG. 7) into the original rest position where it remains (FIG. 8) until winding of the roll on the tube between the arms 3 is completed. The process can then be repeated.

The invention can be used, of course, to wind up other types of webs than plastic foil webs.

As can be seen from FIG. 1, the arms 1 and 3 may be provided with motors 12 and 16 as have been shown diagrammatically, to drive the winding sleeves or tubes during the winding up of the rolls. Motors 10 and 11 can control the angular positions of the pairs of arms 1 and 3.

A motor 13 can actuate the severing unit 8. All of these motors can be computer-controlled motors operated by the controller 14 to bring about the sequencing described. The common pivot assembly defining the axis 4 for the arms 1 and 3 has been represented at 22 in FIG. 9.

I claim:

1. An apparatus for winding a plastic foil web onto a succession of winding tubes, said apparatus comprising:

a contact roller having a periphery and defining a winding position;

means for feeding a plastic foil web in contact with the contact-roller periphery to the winding position;

a pair of first arms engaging a first winding tube between them at said contact roller;

means supporting said first arms for pivoting about an axis of rotation for said pair of first arms;

means for pivoting said pair of first arms about said axis to dispose said first winding tube adjacent the periphery of said contact roller at said winding position;

means rotating the first tube and for thereby winding the plastic foil web fed to said winding position on said first winding tube;

a pair of second arms of the same length as said first arms and pivotable about said axis independently of said first arms, said second arms engaging a second winding tube between them, said pairs of first and second arms lying in respective planes extending radially of the axis and said first arms being wholly axially offset from said second arms so that one of said pairs of arms is disposed inwardly of the other pair of arms and is rotatable independently about said axis without touching the other pair;

means for pivoting said pair of second arms about said axis; and control means for, in sequence:

during winding of a roll of said plastic-foil web onto the first winding tube between said first arms at said winding position, rotating said pair of second arms about said axis in a predetermined sense to position said second winding tube at a waiting position angularly spaced about said axis from said winding position, upon completion of winding of a roll of said plastic foil web on the first winding tube engaged by said pair of first arms, rotating said pair of first arms in said sense out of said winding position to form a stretch of the plastic foil web between said periphery of said contact roller and a periphery of the completed roll and to position the roll in another position angularly spaced in said sense from said winding position about said axis, rotating said second pair of arms about said axis in said sense to displace said second winding tube from said waiting position into said winding position and to position said second winding tube adjacent said periphery of said contact roller for engaging the plastic foil web along the plastic-foil stretch, thereafter transversely severing said plastic-foil web along the plastic-foil stretch to separate the completed roll from the web applied to said second winding tube, angularly displacing said pair of first arms about said axis in said sense into a removal position spaced form said completed position by about 90° and at which said roll is removed, said first and second pairs of arms being rigid and engaging the respective winding tubes at a uniform radial distance from said axis, said tubes being spaced from said axis to said uniform distance in all of the positions, removing the completed roll from between the first arms in the removal position and winding said plastic foil web at said winding position onto said second winding tube between the pair of second arms, and fitting a third winding tube between the first arms from which the roll has been removed for repeating said sequence.

* * * * *